US007753382B2

(12) United States Patent
Choi

(10) Patent No.: US 7,753,382 B2
(45) Date of Patent: Jul. 13, 2010

(54) HYDRAULIC SYSTEM FOR LEVELING APPARATUS IN EXCAVATOR AND FORESTRY EQUIPMENT

(75) Inventor: Han Ok Choi, Masan-si (KR)

(73) Assignee: Volvo Construction Equipment Holding Sweden AB, Eskilstuna (SE)

( * ) Notice: Subject to any disclaimer, the term of this patent is extended or adjusted under 35 U.S.C. 154(b) by 30 days.

(21) Appl. No.: 12/329,646

(22) Filed: Dec. 8, 2008

(65) Prior Publication Data

US 2009/0152025 A1 Jun. 18, 2009

(30) Foreign Application Priority Data

Dec. 17, 2007 (KR) ..... 10-2007-0132673

(51) Int. Cl.
*B60G 17/00* (2006.01)

(52) U.S. Cl. ..... 280/6.153

(58) Field of Classification Search ..... 180/41, 180/89.13–89.15; 280/6.15, 6.153, 6.154, 280/6.155, 6.157
See application file for complete search history.

(56) References Cited

U.S. PATENT DOCUMENTS 4,565,486 A * 1/1986 Crawford et al. ..... 414/729
4,679,803 A * 7/1987 Biller et al. ..... 180/9.23
5,337,847 A * 8/1994 Woods et al. ..... 180/9.52
6,105,699 A * 8/2000 Hinds ..... 180/89.14
6,241,263 B1 * 6/2001 Hicks ..... 280/6.154
2009/0115148 A1 * 5/2009 Kim et al. ..... 280/6.154

* cited by examiner

*Primary Examiner*—Faye M. Fleming
(74) *Attorney, Agent, or Firm*—Ladas and Parry LLP

(57) ABSTRACT

A hydraulic system for a leveling apparatus in excavator and forestry equipment is provided, whereby an upper frame of the equipment is kept in a horizontal state even if a lower frame of the equipment is on an inclined ground against a horizontal surface H. The hydraulic system a pair of first and second actuators and a pair of third and fourth actuators for rocking the lower part of the upper frame, first leveling control valves for simultaneously controlling extension and contraction of the first and second actuators, second leveling control valves for simultaneously controlling extension and contraction of the third and fourth actuators a reducing valve for discharging a reducing pilot signal pressure, and flow control valves for discharging the pilot signal pressure for the spool shifting of the first and second leveling control valves when a control signal is applied from a preset leveling controller.

6 Claims, 6 Drawing Sheets

HYDRAULIC SYSTEM FOR LEVELING APPARATUS IN EXCAVATOR AND FORESTRY EQUIPMENT

CROSS-REFERENCE TO RELATED APPLICATION

This application is based on and claims priority from Korean Patent Application No. 10-2007-0132673, filed on Dec. 17, 2007 in the Korean Intellectual Property Office, the disclosure of which is incorporated herein in its entirety by reference.

BACKGROUND OF THE INVENTION

1. Field of the Invention

The present invention relates to a hydraulic system for a leveling apparatus in excavator and forestry equipment, and more particularly to an improved hydraulic system for a leveling apparatus in excavator and forestry equipment, whereby an upper frame of the equipment is kept in a horizontal state even if a lower frame of the equipment is on an inclined ground against a horizontal surface H.

2. Description of the Prior Art

Conventionally, since an excavator or heavy equipment, such as a tree harvester, a tree feller, or the like, performs a work or moves on an inclined ground, such as a slope, a hill, or the like, against a horizontal surface H, an upper frame of the equipment may be tilted to one side or may overturn due to the inclination of the ground. Accordingly, a leveling apparatus is separately installed between the upper frame and a lower frame to keep the horizontal level of the upper frame uniform.

U.S. Pat. No. 6,609,581 assigned to Tigercat Industries Inc. discloses a leveling mechanism using two actuators. According to the technology disclosed therein, the leveling of equipment is maintained by tilting an upper frame around one tilt shaft on a lower frame provided in a lower frame using the two actuators. However, this technology has the drawback in that a great load is applied to the actuators in accordance with the tilt of the equipment or the upper frame, and thus the manufacture and maintenance/repair of the equipment becomes difficult.

As another leveling system, U.S. Pat. No. 6,173,973 assigned to Timberjack Inc. discloses a leveling mechanism for a forestry machine. According to this technology, one tilt shaft is provided on a frame of a lower frame using four actuators, and the actuators are link-coupled to the tilt shaft and a turntable to tilt an upper frame in every direction. According to this technology, however, since the actuators are arranged to be inclined inside the lower frame and the tilt is performed along with a journal shaft and a link structure, the tilt range of the upper frame may lean upon an inclined ground in the forward/backward direction or an inclined ground in the left/right direction of the equipment, and this makes the control of load required in the actuators difficult. The respective actuators should be separately controlled.

SUMMARY OF THE INVENTION

Accordingly, the present invention has been made to solve the above-mentioned problems occurring in the prior art while advantages achieved by the prior art are maintained intact.

One object of the present invention is to provide a hydraulic system for a leveling apparatus in excavator and forestry equipment, which can stably control the horizontal level of an upper frame by connecting leveling actuators installed on a tilt plate mounted between the upper frame and a lower frame to a leveler flow path branching from a main hydraulic pump and controlling the flow rate of hydraulic fluid being supplied to a working device side during operation of the equipment.

In order to accomplish the above and other objects, there is provided a hydraulic system for a leveling apparatus in excavator and forestry equipment, including an engine, a hydraulic tank, a main hydraulic pump and a pilot pump respectively connected to the engine, a main control valve installed between the main hydraulic pump and the hydraulic pump to control a start, a stop, and a direction change of a working device in accordance with fluid pressure being supplied through a main flow path during a spool shifting of the main control valve, and a tilt plate tiltably installed between an upper frame and a lower frame and provided with a first tilt shaft and a second tilt shaft apart from each other at a specified angle, according to embodiments of the present invention, which includes a pair of first and second actuators, installed between the upper frame and the lower frame, for rocking a lower part of the upper frame in a direction of the first tilt shaft during their extension and contraction, and another pair of third and fourth actuators for rocking the lower part of the upper frame in a direction of the second tilt shaft; first leveling control valves, installed between the main hydraulic pump and the first and second actuators, for simultaneously controlling extension and contraction of the first and second actuators in accordance with fluid pressure being supplied through a leveler flow path branching from the main flow path during the spool shifting; second leveling control valves, installed between the main hydraulic pump and the third and fourth actuators, for simultaneously controlling extension and contraction of the third and fourth actuators in accordance with the fluid pressure being supplied through the leveler flow path branching from the main flow path during the spool shifting; a reducing valve, installed between the leveler flow path and the hydraulic tank, for receiving the fluid pressure from the leveler flow path and discharging a reducing pilot signal pressure; flow control valves, connected between the reducing valve and the first and second leveling control valves, for discharging the pilot signal pressure for the spool shifting of the first leveling control valve and the second leveling control valve when a control signal is applied from a preset leveling controller; shuttle valves, connected to secondary pilot pressure ports of the flow control valves, for discharging the pilot signal pressure to a selector pilot flow path during the spool shifting of either of the first leveling control valve and the second leveling control valve; a shutoff valve, installed at a lowermost downstream of a center bypass flow path connected to the main hydraulic pump, for shutting off the fluid pressure returning to the hydraulic tank through the center bypass flow path in accordance with the pilot signal pressure; and a selector valve, installed between the shutoff valve and the pilot pump, for opening the pilot flow path connected from the pilot pump to the shutoff valve in accordance with the pilot signal pressure being supplied from the shuttle valves.

The hydraulic system for a leveling apparatus according to embodiments of the present invention may further include a first hydraulic flow path connected to a small chamber of the first actuator and a large chamber of the second actuator during the spool shifting of the first leveling control valve.

The hydraulic system for a leveling apparatus according to embodiments of the present invention may further include a second hydraulic flow path connected to a large chamber of the third actuator and a small chamber of the fourth actuator during the spool shifting of the second leveling control valve.

The hydraulic system for a leveling apparatus according to embodiments of the present invention may further include double pilot check valves installed between the actuators and the first and second leveling control valves, respectively.

The flow control valve may be composed of an electro-proportional control valve.

The hydraulic system for a leveling apparatus according to embodiments of the present invention may further include second electro-proportional control valves installed between input ports of the flow control valves and the shuttle valves, respectively.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Hereinafter, a hydraulic system for a leveling apparatus in excavator and forestry equipment according to preferred embodiments of the present invention will be described with reference to the accompanying drawings. The matters defined in the description, such as the detailed construction and elements, are nothing but specific details provided to assist those of ordinary skill in the art in a comprehensive understanding of the invention, and thus the present invention is not limited thereto.

Figure 1:
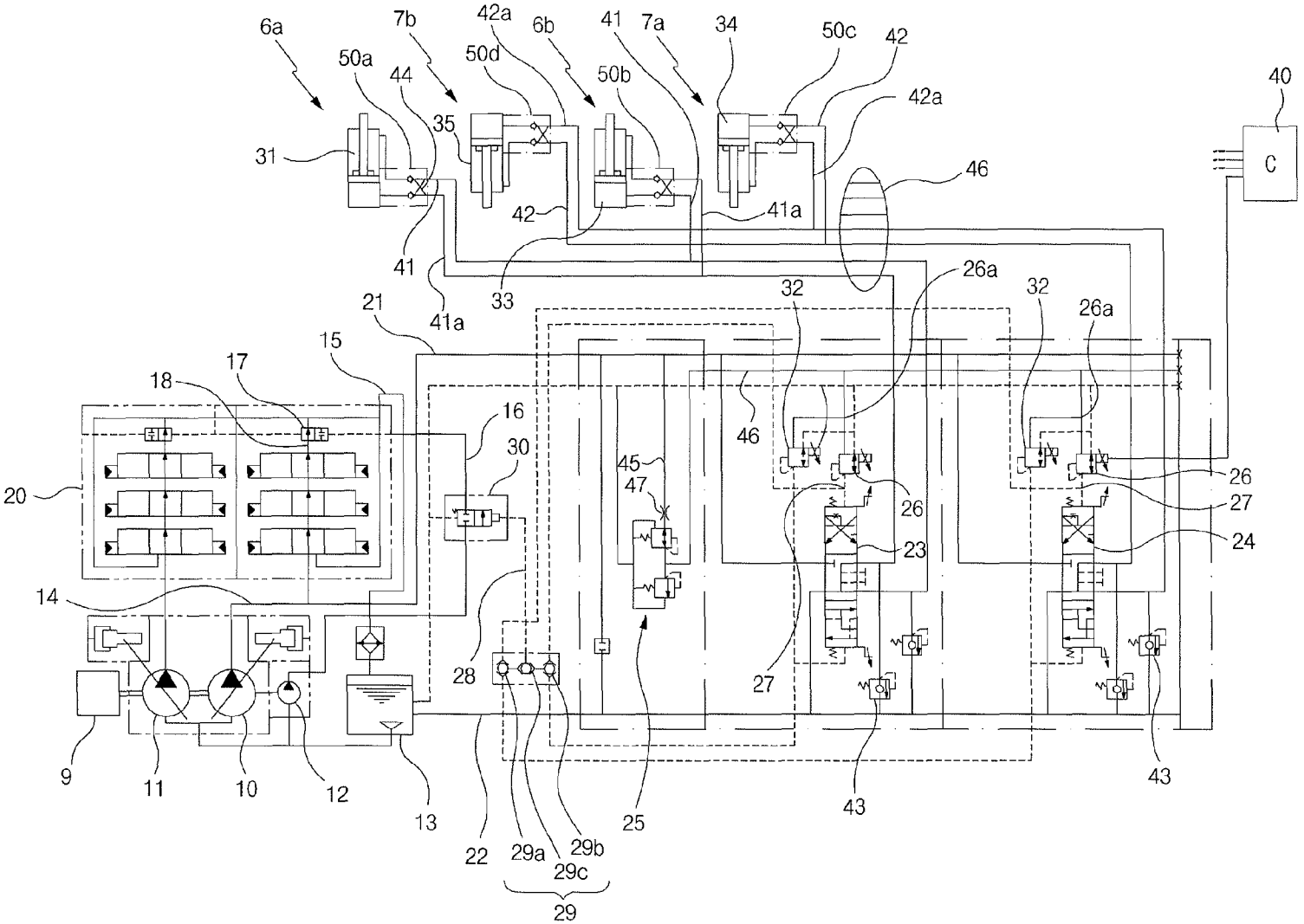
FIG. 1 is a hydraulic circuit diagram of a hydraulic system according to an embodiment of the present invention.
Figure 2:
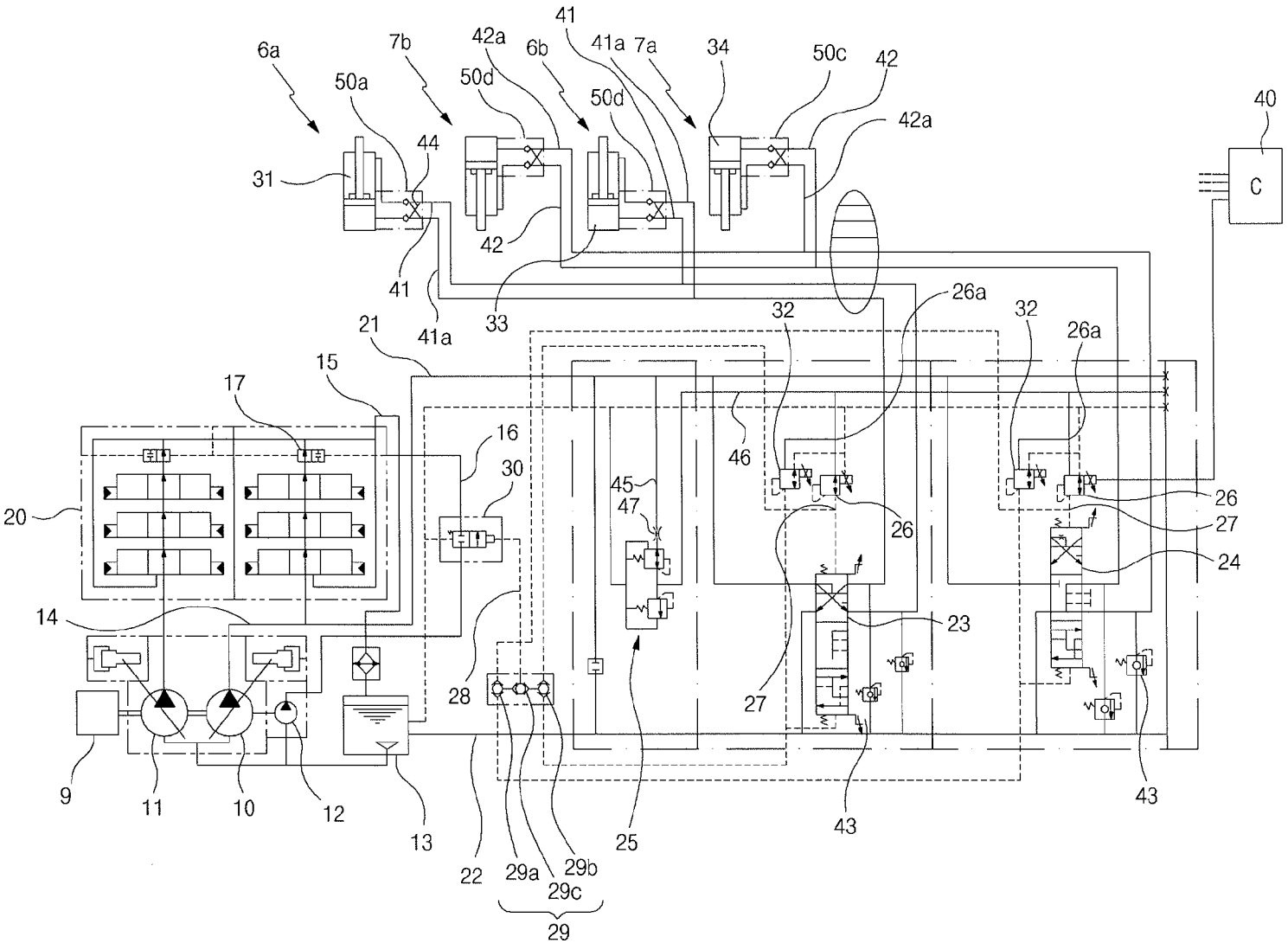
FIG. 2 is a hydraulic circuit diagram of a hydraulic system when the first leveling control valve is shifted according to an embodiment of the present invention.
Figure 3:
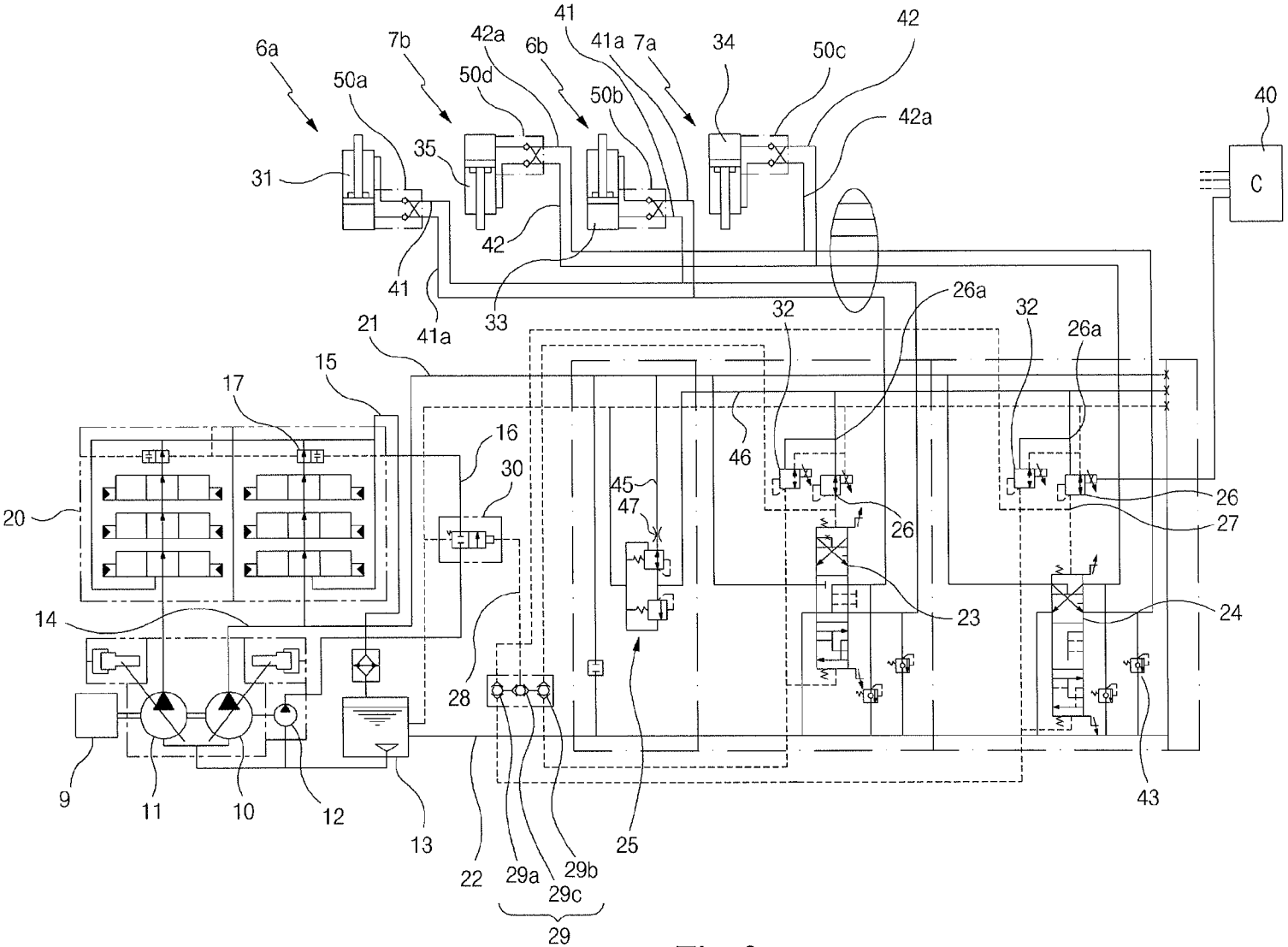
FIG. 3 is a hydraulic circuit diagram of a hydraulic system when the second leveling control valve is shifted according to an embodiment of the present invention.
Figure 4:
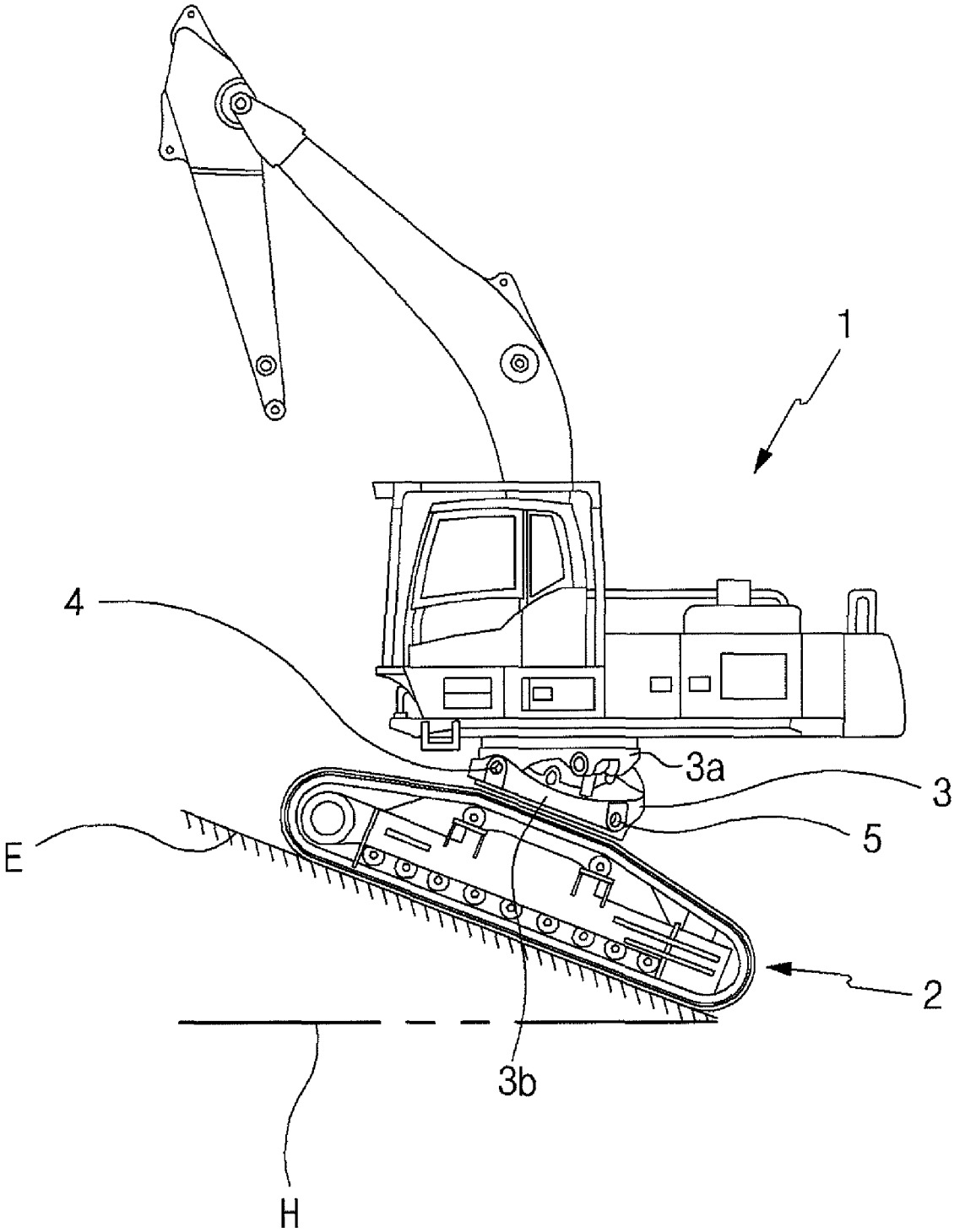
FIG. 4 is a perspective view schematically illustrating an excavator moving on an inclined front area according to an embodiment of the present invention.
Figure 5:
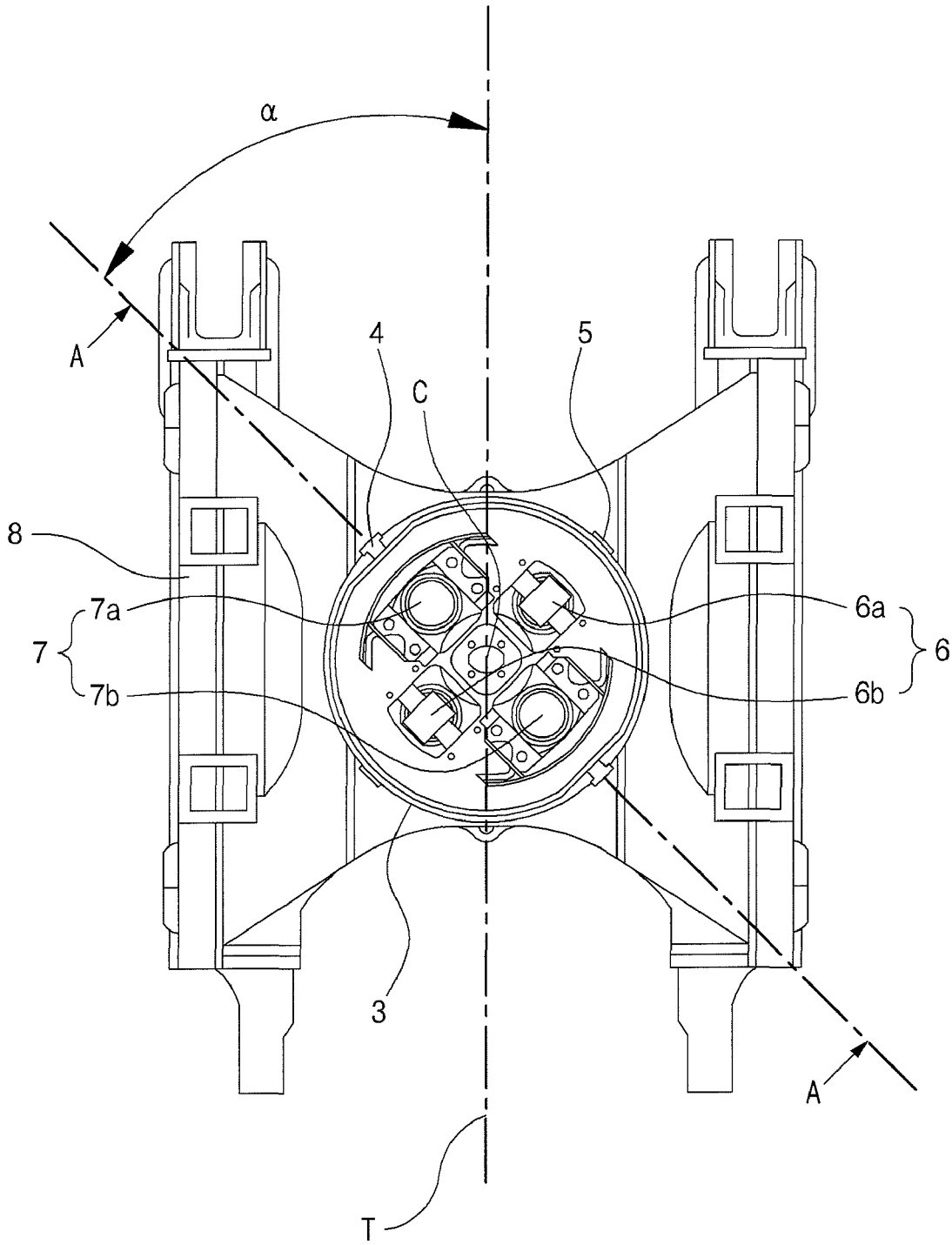
FIG. 5 is a plan view schematically illustrating a mount state of actuators on a tilt plate as illustrated in FIG. 4.
Figure 6:
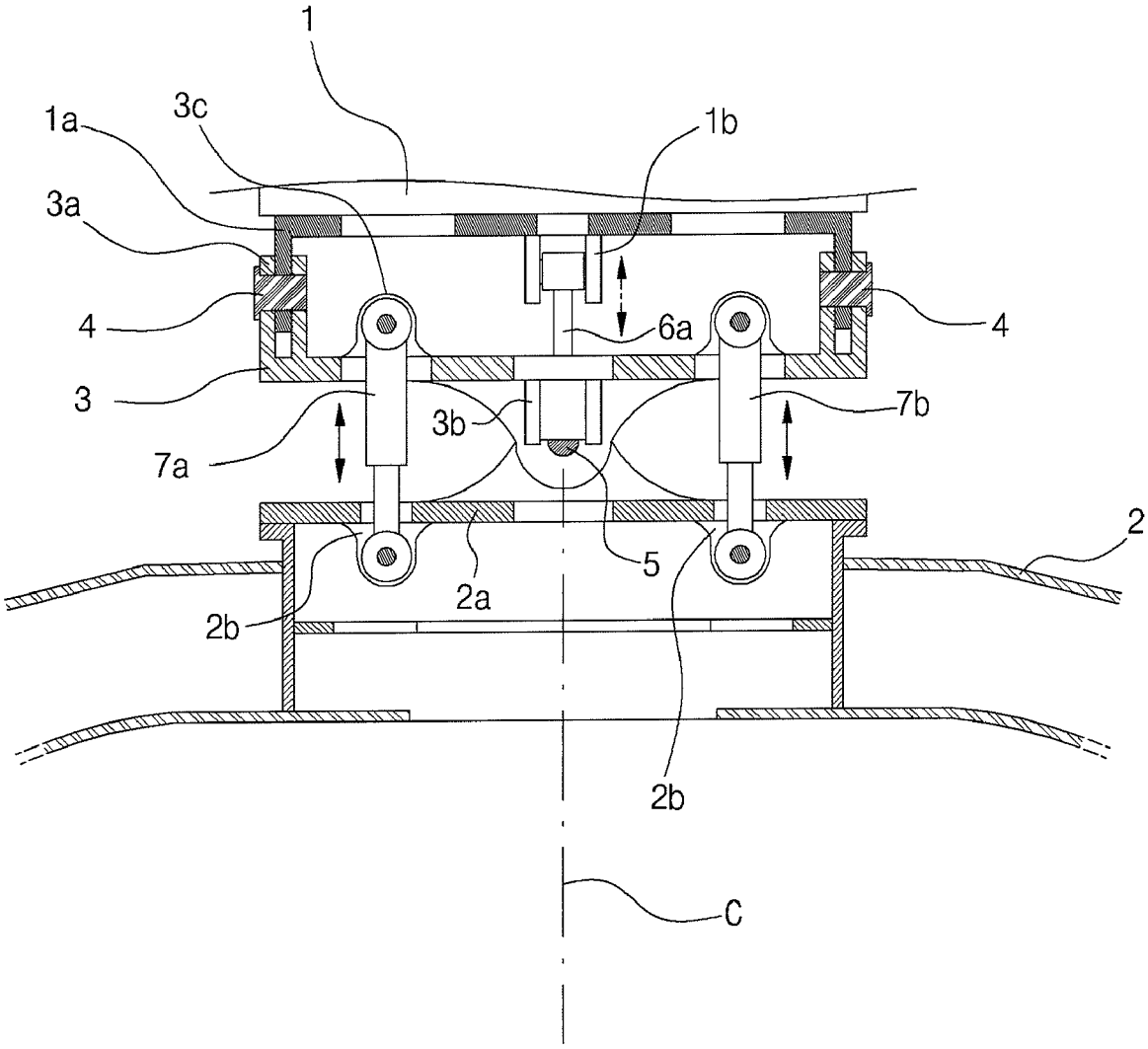
FIG. 6 is a sectional view taken along line A-A in FIG. 5.

FIG. 1 is a hydraulic circuit diagram of a hydraulic system according to an embodiment of the present invention. FIG. 2 is a hydraulic circuit diagram of a hydraulic system when the first leveling control valve is shifted according to an embodiment of the present invention, and FIG. 3 is a hydraulic circuit diagram of a hydraulic system when the second leveling control valve is shifted according to an embodiment of the present invention. FIG. 4 is a perspective view schematically illustrating an excavator moving on an inclined front area according to an embodiment of the present invention. FIG. 5 is a plan view schematically illustrating a mount state of actuators on a tilt plate as illustrated in FIG. 4, and FIG. 6 is a sectional view taken along line A-A in FIG. 5.

As illustrated in the drawings, a hydraulic system for a leveling apparatus in excavator and forestry equipment, including an engine 9, a hydraulic tank 13, a main hydraulic pump 10 and a pilot pump 12 respectively connected to the engine 9, a main control valve 20 installed between the main hydraulic pump 10 and the hydraulic pump 13 to control a start, a stop, and a direction change of a working device (not illustrated) in accordance with fluid pressure being supplied through a main flow path 14 during a spool shifting of the main control valve, and a tilt plate 3 tiltably installed between an upper frame 1 and a lower frame 2 and provided with a first tilt shaft 4 and a second tilt shaft 5 apart from each other at a specified angle, according to embodiments of the present invention, includes a pair of first and second actuators 6*a* and 6*b*, installed between the upper frame 1 and the lower frame 2, for rocking a lower part of the upper frame 1 in a direction of the first tilt shaft 4 during their extension and contraction, and another pair of third and fourth actuators 7*a* and 7*b* for rocking the lower part of the upper frame 1 in a direction of the second tilt shaft 5; first leveling control valves 23, installed between the main hydraulic pump 10 and the first and second actuators 6*a* and 6*b*, for simultaneously controlling extension and contraction of the first and second actuators 6*a* and 6*b* in accordance with fluid pressure being supplied through a leveler flow path 21 branching from the main flow path 14 during the spool shifting; second leveling control valves 24, installed between the main hydraulic pump 10 and the third and fourth actuators 7*a* and 7*b*, for simultaneously controlling extension and contraction of the third and fourth actuators 7*a* and 7*b* in accordance with the fluid pressure being supplied through the leveler flow path 21 branching from the main flow path 14 during the spool shifting; a reducing valve 25, installed between the leveler flow path 21 and the hydraulic tank 13, for receiving the fluid pressure from the leveler flow path 21 and discharging a reducing pilot signal pressure; flow control valves 26, connected between the reducing valve 25 and the first and second leveling control valves 23 and 24, for discharging the pilot signal pressure for the spool shifting of the first leveling control valve 23 and the second leveling control valve 24 when a control signal C is applied from a preset leveling controller 40; shuttle valves 29, connected to secondary pilot pressure ports 27 of the flow control valves 26, for discharging the pilot signal pressure to a selector pilot flow path 28 during the spool shifting of either of the first leveling control valve 23 and the second leveling control valve 24; a shutoff valve 17, installed at a lowermost downstream of a center bypass flow path 18 connected to the main hydraulic pump 10, for shutting off the fluid pressure returning to the hydraulic tank 13 through the center bypass flow path 18 in accordance with the pilot signal pressure; and a selector valve 30, installed between the shutoff valve 17 and the pilot pump 12, for opening the pilot flow path 16 connected from the pilot pump 12 to the shutoff valve 17 in accordance with the pilot signal pressure being supplied from the shuttle valves 29.

The main control valve 20 controls the operation of working devices, such as a bucket required in a typical excavator and forestry equipment, a feller header, a boom, and the like, and includes a plurality of directional valves connected in series to the center bypass flow path 18 for receiving a supply of fluid pressure from the main hydraulic pump 10 through the main flow path 14 to control a start, a stop, and a direction change of such working devices. The main control valve may further include a confluence valve for the confluence of fluid pressure of the second hydraulic pump 11.

In an embodiment of the present invention, the hydraulic system for a leveling apparatus further includes a first hydraulic flow path 41 connected to a small chamber 31 of the first actuator 6*a* and a large chamber 33 of the second actuator 6*b* during the spool shifting of the first leveling control valve 23. Also, the hydraulic system for a leveling apparatus further includes a second hydraulic flow path 42 connected to a large chamber 34 of the third actuator 7*a* and a small chamber 35 of the fourth actuator 7*b* during the spool shifting of the second leveling control valve 24.

In the drawings, the reference numeral "41*a*" denotes a return flow path through which the fluid pressure returns from the first actuator 6*a* and the second actuator 6*b* to the first leveling control valve 23 during the extension and contraction of the first and second actuators 6*a* and 6*b*, and "42*a*" denotes a return flow path through which the fluid pressure returns from the third actuator 7*a* and the fourth actuator 7*b* to the second leveling control valve 24 during the extension and contraction of the third and fourth actuators 7*a* and 7*b*.

The hydraulic system for a leveling apparatus according to an embodiment of the present invention further includes double pilot check valves 50*a*, 50*b*, 50*c*, and 50*d* installed between the actuators 6*a*, 6*b*, 7*a*, and 7*b* and the first and second leveling control valves 23 and 24, respectively. Preferably, the double pilot check valves 50*a*, 50*b*, 50*c*, and 50*d* are provided with cross flow paths 44, and are installed on the first hydraulic flow path 41 and the second hydraulic flow path 42.

In an embodiment of the present invention, the flow control valve 26 is composed of an electro-proportional control valve, and the electro-proportional control valve is suitable to proportionally control the pilot signal pressure introduced from the reducing valve 25 in accordance with the control signal C from the leveling controller 40. This means that the spool shift state (which corresponds to the change of a valve open area) of the first leveling control valve 23 and the second leveling control valve 24 is controlled in accordance with the control signal C from the leveling controller 24, which could be clearly understood by those skilled in the art.

The fluid pressure introduced into the reducing valve 25 is discharged from the hydraulic pump 10, and is provided to the input ports 26*a* of the electro-proportional control valves 26 through the leveler flow path 21, an orifice 47, and a flow path 45.

The hydraulic system for a leveling apparatus according to an embodiment of the present invention further includes second electro-proportional control valves 32 installed between the input ports 26*a* of the flow control valves 26 and the shuttle valves 29, respectively. The second electro-proportional control valves 32 provide input pilot pressure of the electro-proportional control valves to the shuttle valves 29.

The leveling control signal C from the leveling controller 40 may be provided to the second electro-proportional control valves 32.

The shuttle valves 29 are connected to output ports 27 of the flow control valves 26, and sense the fluid pressures of the input ports 26*a* and the output ports 27 of the flow control valves 26. Preferably, the shuttle valves 29 include a plurality of shuttle valves 29*a*, 29*b*, and 29*c* connected in parallel to sense the fluid pressures of the input ports 26*a* and the output ports 27 of the flow control valves 26 for controlling the spool shifting of the first leveling control valve 23 and the second leveling control valve 24.

In an embodiment of the present invention, relief valves 43 are further installed between the first and second leveling control valves 23 and 24 and a second return flow path 22.

In an embodiment of the present invention, as illustrated in FIGS. 4 and 5, the tilt plate 3 installed between the upper frame 1 and the lower frame 2 is installed on left and right sides at a specified angle on the basis of a center line T in a length direction of the lower frame 2. The first actuator 6*a* and the second actuator 6*b* are installed along the first tilt shaft 4, and the third actuator 7*a* and the fourth actuator 7*b* are installed along the second tilt shaft 5.

More specifically, referring to FIG. 6, for tiltable connection to the tilt plate 3, a pair of actuator holders 1*b* is provided on a lower part of the upper frame, on which typical swing bearings are mounted, to be coupled to the tilt plate 3. Preferably, the first and second actuators 6*a* and 6*b*, e.g. actuator pistons, are rotatably fixed into the actuator holders 1*b*.

Roughly, in the center position of the lower frame 2, a tilt plate lower support plate 2*a* having a pair of actuator holders 2*b* is provided. Preferably, the third and fourth actuators 7*a* and 7*b*, e.g. actuator pistons, are rotatably fixed into the actuator holders 2*b*.

The tilt plate 3 includes a pair of first pivot holders 3*a* formed to project upward to support the lower part of the upper frame 1, a pair of second pivot holders 3*b* formed to project downward and radially apart from the first pivot holders 3*a* by 90° to support the tilt plate lower support plate 2*a*, and a plurality of actuator holders 3*c* for rotatably fixing one side of the respective actuators 6*a*, 6*b*, 7*a*, and 7*b*.

For tiltable connection to the tilt plate 3, the lower part of the upper frame 1 and the tilt plate lower support plate 2*a* are rotatably fixed to the pair of first pivot holders 3*a* and the pair of second pivot holders 3*b*, respectively. In this case, the first tilt shaft 4 rotatably fixes the lower part of the upper frame 1 to the first pivot holders 3*a* of the tilt plate 3 in a shaft coupling method, whereas the second tilt shaft 5 crossing in an opposite direction to the first tilt shaft A rotatably fixes the tilt plate lower support plate 2*a* to the second pivot holders 3*b*.

The actuator holders 3*c* of the tilt plate 3 rotatably fix cylinders of the first to fourth actuators 6*a*, 6*b*, 7*a*, and 7*b*.

As a result, the cylinder sides of the actuators 6*a*, 6*b*, 7*a*, and 7*b* are fixed to the actuator holders 3*c* of the tilt plate 3, whereas their pistons are fixed to the lower part of the upper frame 1 and the actuator holders 1*b* and 2*b* of the tilt plate lower support plate 2*a*, so that the lower part of the upper frame 1 seesaws or rocks along the first tilt shaft 4 and the second tilt shaft 5 to control the tilt leveling against the horizontal surface during expansion and contraction of the actuators.

In an embodiment of the present invention, the arrangement of the first tilt shaft 4 and the second tilt shaft 5 can be diversely modified.

In operation, as illustrated in FIG. 4, the excavator and forestry equipment typically travels or works on an inclined ground E against the horizontal surface H, and in this case, the horizontal level of the upper frame 1 is controlled depending on the degree of inclination against the horizontal surface H.

For example, in the case where the second tilt shaft 5 is level with the ground E, but the first tilt shaft 5 is inclined against the ground E, it is required for the lower part of the upper frame 1 to seesaw along the first tilt shaft 4 to offset the inclination of the first tilt shaft 4. In this case, referring to FIGS. 5 and 6, the piston of the third actuator 7*a* fixed to the actuator holder 3*c* of the tilt plate 3 expands, and simultaneously the piston of the fourth actuator 7*b* in an opposite position contracts.

Accordingly, the lower part of the upper frame 1 seesaws along the first tilt shaft 4 to keep the horizontal level against the ground E.

If the second tilt shaft 5 is in an inclined state, the piston of the first actuator 6*a* expands and simultaneously the piston of the second actuator 6*b* in an opposite position contracts, so that the lower part of the upper frame 1 seesaws along the second tilt shaft 5 to keep the horizontal level against the ground E.

As described above, as the respective actuators 6*a*, 6*b*, 7*a*, and 7*b* continuously expand and contract, the lower part of the upper frame 1 is level with the horizontal surface E.

More specifically, referring to FIG. 2, if the upper frame 1 or the equipment is inclined along the first tilt shaft 4, the hydraulic fluid discharged from the hydraulic pump 10 is supplied to the first leveling control valve 23 and the second leveling control valve 24 through the leveler flow path 21, and simultaneously the hydraulic fluid discharged from the reducing valve 25 through the branch flow path 45 is supplied to the input port 26*a* of the electro-proportional control valve 26 via a flow path 46 to form the fluid pressure at the input port 26*a* of the electro-proportional control valve 26. At this time, the electro-proportional control valve 26 is opened in accordance with the leveling control signal C from the leveling controller 40, and the pilot signal pressure applied from the reducing valve 25 shifts the valve spool of the first leveling control valve 23 downward.

During the spool shifting of the first leveling control valve, the hydraulic fluid is supplied to the small chamber 31 of the first actuator 6*a* through the main flow path 15, the leveler flow path 21, and the first hydraulic flow path 41, and simultaneously is supplied to the large chamber 33 of the second actuator 6*b* through the first hydraulic flow path 41.

As the first actuator 6*a* contracts and the second actuator 6*b* expands, the upper frame 1 is kept at a horizontal level against the inclined lower frame 2.

The hydraulic fluid supplied to the first and second actuators 6*a* and 6*b* for their expansion and contraction returns to the hydraulic tank 13 through the return flow path 41*a* and the second return flow path 22.

On the other hand, the pilot pressures connected to the input port 26*a* and the output port 27 of the electro-proportional control valves 26 are applied to the shuttle valve 29 to shift the selector valve 30, and thus the shutoff valve 17 is shifted to close the center bypass flow path 18 by the pilot pressure introduced from the pilot pump 12.

This means that the main control valve 20 for controlling a working device, such as a bucket for an excavator or the filler header for forestry equipment, is in a neutral state to shut off the returning fluid pressure, and thus the output of the hydraulic pump 10 can be efficiently used for the leveling control.

If the equipment travels on a hill inclined toward the left front side or the side of the equipment, the control signal C from the leveling controller is successively or continuously inputted to the electro-proportional control valves 26, based on a predetermined algorithm, to simultaneously shift the first leveling control valve 23 and the second leveling control valve 24, and thus the equipment and the upper frame 1 are kept at a horizontal level in the same manner as described above.

As described above, the hydraulic system for a leveling apparatus in excavator and forestry equipment according to embodiments of the present invention can stably control the horizontal level of an upper frame by connecting the leveling actuators installed on the tilt plate mounted between the upper frame and the lower frame to the leveler flow path branching from the main hydraulic pump and controlling the flow rate of hydraulic fluid being supplied to a working device side during the operation of the equipment.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A hydraulic system for a leveling apparatus in excavator and forestry equipment, including an engine, a hydraulic tank, a main hydraulic pump and a pilot pump respectively connected to the engine, a main control valve installed between the main hydraulic pump and the hydraulic pump to control a start, a stop, and a direction change of a working device in accordance with fluid pressure being supplied through a main flow path during a spool shifting, and a tilt plate tiltably installed between an upper frame and a lower frame and provided with a first tilt shaft and a second tilt shaft apart from each other at a specified angle, the hydraulic system comprising:

a pair of first and second actuators, installed between the upper frame and the lower frame, for rocking a lower part of the upper frame in a direction of the first tilt shaft during their extension and contraction, and another pair of third and fourth actuators for rocking the lower part of the upper frame in a direction of the second tilt shaft;

first leveling control valves, installed between the main hydraulic pump and the first and second actuators, for simultaneously controlling extension and contraction of the first and second actuators in accordance with fluid pressure being supplied through a leveler flow path branching from the main flow path during the spool shifting;

second leveling control valves, installed between the main hydraulic pump and the third and fourth actuators, for simultaneously controlling extension and contraction of the third and fourth actuators in accordance with the fluid pressure being supplied through the leveler flow path branching from the main flow path during the spool shifting;

a reducing valve, installed between the leveler flow path and the hydraulic tank, for receiving the fluid pressure from the leveler flow path and discharging a reducing pilot signal pressure;

flow control valves, connected between the reducing valve and the first and second leveling control valves, for discharging the pilot signal pressure for the spool shifting of the first leveling control valve and the second leveling control valve when a control signal is applied from a preset leveling controller;

shuttle valves, connected to secondary pilot pressure ports of the flow control valves, for discharging the pilot signal pressure to a selector pilot flow path during the spool shifting of either of the first leveling control valve and the second leveling control valve;

a shutoff valve, installed at a lowermost downstream of a center bypass flow path connected to the main hydraulic pump, for shutting off the fluid pressure returning to the hydraulic tank through the center bypass flow path in accordance with the pilot signal pressure; and a selector valve, installed between the shutoff valve and the pilot pump, for opening the pilot flow path connected from the pilot pump to the shutoff valve in accordance with the pilot signal pressure being supplied from the shuttle valves.

2. The hydraulic system of claim 1, further comprising a first hydraulic flow path connected to a small chamber of the first actuator and a large chamber of the second actuator during the spool shifting of the first leveling control valve.

3. The hydraulic system of claim 1, further comprising a second hydraulic flow path connected to a large chamber of the third actuator and a small chamber of the fourth actuator during the spool shifting of the second leveling control valve.

4. The hydraulic system of claim 1, further comprising double pilot check valves installed between the actuators and the first and second leveling control valves, respectively.

5. The hydraulic system of claim 1, wherein the flow control valve is composed of an electro-proportional control valve.

6. The hydraulic system of claim 1, further comprising second electro-proportional control valves installed between input ports of the flow control valves and the shuttle valves, respectively.

* * * * *